US005621390A

United States Patent [19]

Neal

[11] Patent Number: 5,621,390

[45] Date of Patent: Apr. 15, 1997

[54] TEMPERATURE ACTUATED SIGNALING AND ENTERTAINMENT APPARATUS

[76] Inventor: Albert D. Neal, 17272 Blue Fox Cir., Huntington Beach, Calif. 92647

[21] Appl. No.: 532,054

[22] Filed: Sep. 22, 1995

[51] Int. Cl.[6] ..... G08B 17/00

[52] U.S. Cl. ..... 340/584; 340/586; 340/691; 340/693; 374/156; 73/449; 73/292; 4/541.1; 4/541.4

[58] Field of Search ..... 340/586, 622, 340/584, 691, 693; 374/156, 208, 210; 73/449, 292; 4/541.1, 541.4

[56] References Cited

U.S. PATENT DOCUMENTS

| | | | |
|---|---|---|---|
| 4,030,361 | 6/1977 | Fortune | 374/156 |
| 4,503,563 | 3/1985 | Johnson | 374/156 |
| 4,733,675 | 3/1988 | Destro | 340/622 |
| 4,922,226 | 5/1990 | Hsieh et al. | 73/292 |
| 4,931,775 | 6/1990 | Sheriff | 340/693 |
| 5,152,610 | 10/1992 | Hallett | 374/156 |
| 5,169,236 | 12/1992 | Iest | 374/156 |
| 5,302,028 | 4/1994 | Carey | 340/586 |
| 5,371,491 | 12/1994 | Wu | 340/622 |

*Primary Examiner*—Thomas Mullen
*Assistant Examiner*—Benjamin C. Lee
*Attorney, Agent, or Firm*—Donald W. Meeker

[57] ABSTRACT

A waterproof housing encases a radio and/or a television and/or a compact disc and/or a tape cassette player and speaker or other signaling and entertainment apparatus actuated by a programmable temperature actuated control and temperature indicator. A temperature probe senses the temperature in a heated environment. The control activates the signaling and entertainment device when the temperature is within a preset temperature limit range. The housing is floatable for a spa, whirlpool, hot tub, bathtub, flotation chamber, or other heated water environment.

16 Claims, 1 Drawing Sheet

TEMPERATURE ACTUATED SIGNALING AND ENTERTAINMENT APPARATUS

BACKGROUND OF THE INVENTION

1. Technical Field

The present invention relates to signaling devices, and in particular, to a signaling and entertainment apparatus controlled by programmable temperature actuated controls.

2. Description of the Prior Art

In using any heated environment, it is important to be aware of the temperature and often desirable to preset desired temperature limits for the heated environment. Applications vary widely, including cooking environments, heated water environments, laboratory environments employing heat, sterilization environments, hot house environments, and many other situations involving temperature variations where an audible signal of preset temperature limits is desirable. In situations where no signal is provided, constant checking of the temperature is required to determine when the temperature reaches a desired limit.

Temperature indicating signals are very important in dealing with heated environments to create awareness that the heated environment has reached a desired preset temperature. Audible alarms or signals to indicate preset temperatures are often annoying and sometimes shocking. It is desirable to provide an audible alarm using a more pleasing signal such as an audible entertainment device.

In using a spa, hot tub, whirlpool, pool, bathtub, flotation chamber, or other heated water environment, one problem is the need to keep checking the temperature of the water until it reaches a desired temperature level for use. Relaxation in a heated water environment is greatly enhanced with music or other soothing sounds or favorite programs which can be played on entertainment apparatus such as a compact disc (CD) or tape cassette player, or a radio or television. The temperature of the water environment in which the person is immersed is another significant factor in helping the person to relax.

Providing a signal and an indicator of comfortable water temperature by means of relaxing music or sounds or programs for a spa, sauna, pool, bathtub, flotation chamber, or other heated water environment would create an ideal environment for relaxation.

A number of prior art devices provide for control of temperature related to water. European patent application publication #0175552, application #85306480.6 by Snell et al, and UK patent #2228068A by Hannibal both describe water temperature sensing devices which activate alarms when the water exceeds a desired temperature level and also control the flow of water. U.S. Pat. No. 5,371,491 issued to Wu provides a water temperature sensing device which controls the flow of hot water and also an alarm on a speaker of a radio. In this case, the ratio may also be played while the alarm is not sounding. Alarms are definitely not relaxing, as anyone who uses an alarm clock to wake up in the morning will testify.

None of the prior art provides a programmable temperature sensing means which actuates a signaling and entertainment means.

DISCLOSURE OF THE INVENTION

The present invention provides a signaling and entertainment means for sounding a pleasing alarm signal when the temperature in a heated environment reaches a desired preset level. This signaling and entertainment means creates a relaxing sound rather than a disturbing alarm signal. The present invention provides a programmable temperature actuated control having temperature sensing and indicating means and controlled by a microprocessor enabling selection of a preset temperature limit within a desired preset range. When the temperature sensing probe senses that the temperature is within the desired preset range, the programmable temperature actuated control turns on a signaling and entertainment apparatus, such as a radio, a television, or a tape cassette or CD player playing selected music, programs, or other desired output, thereby providing entertaining sounds as a signal and temperature level indicator. This maintains a more pleasant, relaxed environment. In the case of a heated water environment, the signaling and entertainment means further enhances the comport and relaxation of the experience by providing desired music or sounds or programs playing while the user is immersed in the comfortable heated water. When the temperature sensing probe senses that the temperature of the heated water environment falls outside of the preselected temperature limit range, the programmable temperature actuated control turns off the signaling and entertainment apparatus.

A floating signaling and entertainment apparatus, such as a radio, a television, or a tape cassette or CD player, is encased in a waterproof case which floats in a water environment, such as a spa, whirlpool, hot tub, pool, bathtub, flotation chamber, or other heated water environment, adjacent to the person relaxing therein for easy access to change the selection of signaling and entertainment output and desired temperature range.

Also encased in the waterproof floating casing, the programmable temperature actuated control and the signaling and entertainment apparatus are both powered by batteries encased in a watertight battery compartment within the housing.

The present invention also incorporates a readable temperature indicator in the form of a lighted display, such as an LED (light emitting diode) or an LCD (liquid crystal diode) display, or a mechanical temperature indicator such as an adjustable thermistor controlled by a probe with a relay or a thermometer on the controls of the floating signaling and entertainment apparatus to inform the person in the water of the actual temperature of the water.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
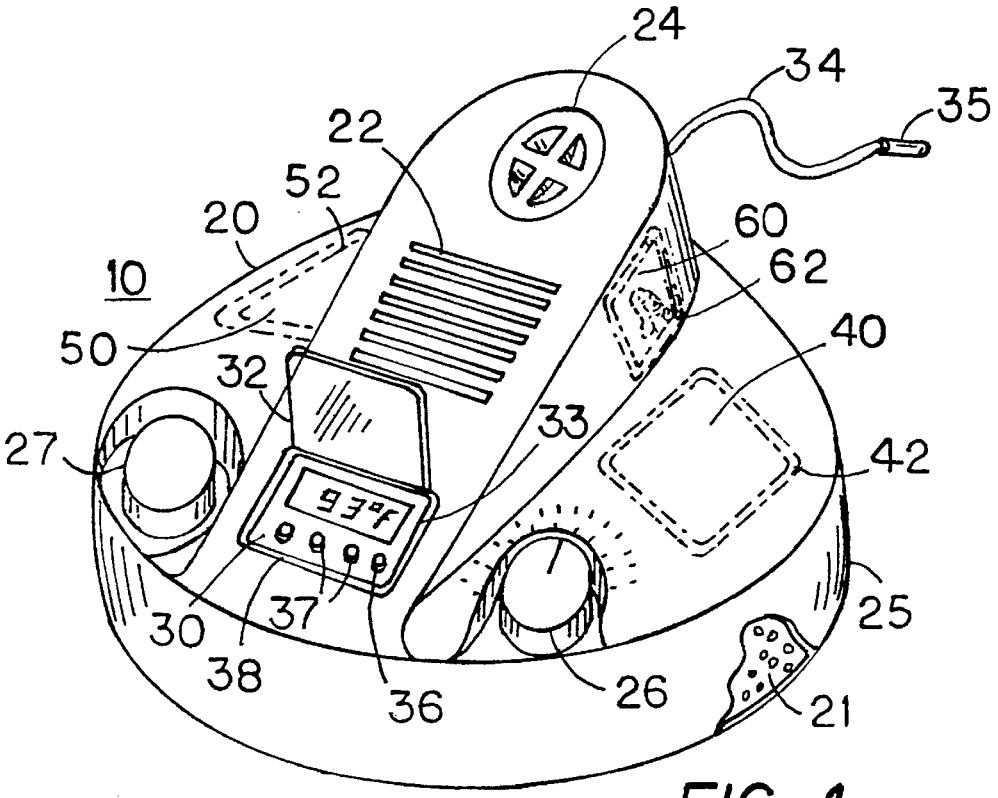
FIG. 1 is a perspective view in partial section showing the floatable signaling and entertainment module with the programmable temperature actuated control and temperature display.
Figure 3:
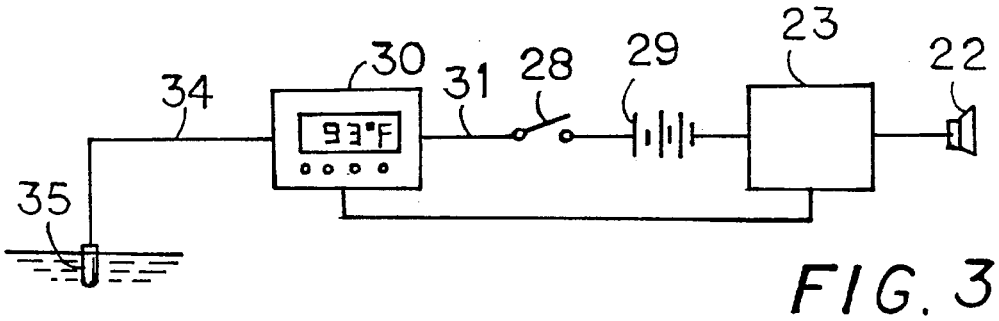
FIG. 3 is a diagrammatic view showing the operational components of the invention.

In FIGS. 1 and 3, a temperature actuated signaling and entertainment apparatus 10 for heated environments comprises a housing 20 having an exterior shell which is sealed against the admission of water in heated water environments and a signaling and entertainment means 23, such as a radio and/or a television and/or a tape cassette player and/or a CD player, and a speaker 22 encased within the housing. An on/off switch 28 controlling the playing of the signaling and entertainment means 23 is actuated by a programmable temperature actuated control 30 having a temperature sensing means such as a temperature probe 35 positioned in the heated environment connected by a wire 34 to the programmable temperature actuated control 30 to the on/off switch 28 actuated the on/off switch 28 to turn the signaling and entertainment means 23 on when the temperature in the heated environment is within a desired preset temperature limit range, and turn the signaling and entertainment means off when the temperature in the heated environment is outside of the desired preset temperature range. Preferred relaxation music may be played on any of the signaling and entertainment means or soothing sounds, such as environmental sounds of ocean waves or running brooks may be played on a tape cassette or CD player.

As seen in the cutaway portion of the housing base 25 in FIG. 1, the housing further comprises a lighter than water means, such as synthetic foam 21 base, or just a hollow boat-like base, making the housing floatable in the heated water environment.

The programmable temperature actuated control 30 is encased within a compartment in the housing, the compartment sealed against the admission of water for heated water environments. Both the signaling and entertainment means 23 and the programmable temperature actuated control 30 are powered by batteries 29 encased within the housing in a watertight battery compartment 24. The preferred programmable temperature actuated control 30 comprises a programmable control having an integrated circuit. Control buttons 37 enable programming of the programmable temperature actuated control to a set desired temperature range. A readable display 33 indicates the actual water temperature using light emitting diodes or liquid crystal diodes or mechanical temperature indicating means such as a thermometer or thermistor.

The compartment further comprises an opening having a transparent cover 32 hinged thereto over the programmable temperature actuated control 30 and temperature indicating means 33, and a rubberized seal 38 between the cover and the opening preventing the admission of water therein.

Figure 2:
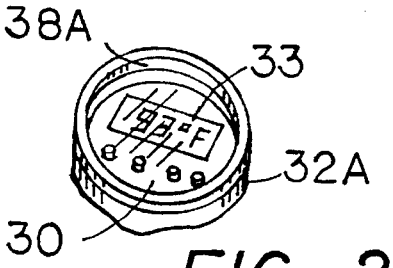
FIG. 2 is a perspective view of an alternate embodiment of the cover for the compartment housing the programmable temperature actuated control.

In FIG. 2, an alternate embodiment of the compartment cover comprises a threaded opening and a transparent threaded cover 32A screwed onto the threaded opening of the compartment over the programmable temperature actuated control 30 and a temperature indicating means 33, and a rubberized seal 38A between the cover and the threaded opening preventing the admission of water therein.

In a preferred embodiment, the signaling and entertainment means 23 comprises an AM/FM radio and speaker 22 enclosed within the housing and having exterior volume 27 and tuning controls 26 outside the housing. An AM/FM selection switch 36 is housed within the compartment of the programmable temperature actuated control 30 and the temperature indicating means 33.

In an alternate embodiment, the signaling and entertainment means 23 comprises a television and speaker 22 enclosed within the housing and having exterior volume 27 and tuning controls 26 outside the housing. A miniature television screen 60 is built into the exterior of the housing with a watertight seal 62 around the screen.

In another alternate embodiment, the signaling and entertainment means 23 comprises a tape cassette player and speaker 22 enclosed within the housing. The housing further comprises an opening for inserting and removing tape cassettes and the housing further comprises a cover 40 hinged to the opening and a rubberized seal 42 between the cover and the opening preventing the admission of water therein.

In another alternate embodiment, the signaling and entertainment means 23 comprises a compact disc player and speaker 22 enclosed within the housing. The housing further comprises an opening for inserting and removing compact discs and the housing further comprises a cover 50 hinged to the opening and a rubberized seal 52 between the cover and the opening preventing the admission of water therein.

All three signaling and entertainment means may be incorporated in one unit or any combination thereof. The housing is preferably fabricated of molded plastic.

In operation, the temperature actuated signaling and entertainment apparatus 10 is positioned in a desirable location for listening and the temperature sensing probe 35 is positioned in the heated environment. The programmable temperature actuated control is programmed to set the desired temperature limits. When the limits are reached, the signaling and entertainment apparatus is activated by the control.

In operation in a heated water environment, the temperature actuated signaling and entertainment apparatus 10 is floated in the spa, whirlpool, hot tub, bathtub, flotation chamber, or other heated water environment, and the temperature sensing probe 35 is dropped into the water. The programmable temperature actuated control is programmed to activate the signaling and entertainment means 23 within a desired temperature range for comfortable immersion in the water. When the water temperature is within the desired range, the programmable temperature actuated control turns on the signaling and entertainment means 23 providing desired entertainment as a signal that a predetermined desired temperature is reached. When the water temperature falls outside of the desired range the programmable temperature actuated control turns off the signaling and entertainment means.

It is understood that the preceding description is given merely by way of illustration and not in limitation of the invention and that various modifications may be made thereto without departing from the spirit of the invention as claimed.

What is claimed is:

1. A temperature actuated signaling and entertainment apparatus for a heated environment, wherein the apparatus comprises:

a housing;

a signaling and entertainment means encased within the housing and having an on/off switch controlling the playing of the signaling and entertainment means;

a programmable temperature actuated control having a temperature sensing means contacting the heated environment, a temperature indicating means on the housing, a connector between the programmable temperature actuated control and the on/off switch, and a means for programming the temperature actuated control to activate the on/off switch between the preset temperature limits for the heated environment, so that the programmable temperature actuated control actuates the on/off switch to turn the signaling and entertainment means on when the temperature in the heated environment is within the preset temperature limits and turn the signaling and entertainment means off when the temperature in the heated environment is outside the preset temperature limits;

wherein the housing has an exterior shell sealed against the admission of water and the heated environment is a heated water environment;

wherein the housing further comprises a lighter than water means making the housing floatable in the heated environment;

wherein the programmable temperature actuated control and temperature indicating means are encased within a compartment in the housing, the compartment sealed against the admission of water; and wherein the signaling and entertainment means comprises an AM/FM radio and speaker enclosed within the housing and having volume and tuning controls secured on the exterior of the housing.

2. The apparatus of claim 1 wherein the compartment further comprises an opening having a transparent cover hinged thereto over the programmable temperature actuated control, and a rubberized seal between the cover and the opening preventing the admission of water therein.

3. The apparatus of claim 1 wherein the compartment further comprises a threaded opening and a transparent threaded cover screwed onto the threaded opening of the compartment over the programmable temperature actuated control and indicating means, and a rubberized seal between the cover and the threaded opening preventing the admission of water therein.

4. The apparatus of claim 1 wherein an AM/FM selection switch is housed within the compartment of the programmable temperature actuated control.

5. The apparatus of claim 1 wherein the signaling and entertainment means, the programmable temperature actuated control, and the temperature indicating means are each powered by batteries encased within the housing.

6. The apparatus of claim 1 wherein the temperature sensing means comprises a temperature probe immersed in the heated water environment.

7. The apparatus of claim 1 wherein the programmable temperature actuated control further comprises an integrated circuit.

8. The apparatus of claim 1 wherein the temperature indicating means comprises a readable display indicating temperature.

9. The apparatus of claim 8 wherein the readable display is a light emitting diode display.

10. The apparatus of claim 8 wherein the readable display is a liquid crystal diode display.

11. The apparatus of claim 8 wherein the readable display is a mechanical means of sensing and indicating temperature.

12. A temperature actuated signaling and entertainment apparatus for a heated environment, wherein the apparatus comprises:

a housing;

a signaling and entertainment means encased within the housing and having an on/off switch controlling the playing of the signaling and entertainment means;

a programmable temperature actuated control having a temperature sensing means contacting the heated environment, a temperature indicating means on the housing, a connector between the programmable temperature actuated control and the on/off switch, and a means for programming the temperature actuated control to activate the on/off switch between the preset temperature limits for the heated environment, so that the programmable temperature actuated control actuates the on/off switch to turn the signaling and entertainment means on when the temperature in the heated environment is within the preset temperature limits and turn the signaling and entertainment means off when the temperature in the heated environment is outside the preset temperature limits;

wherein the housing has an exterior shell sealed against the admission of water and the heated environment is a heated water environment;

wherein the housing further comprises a lighter than water means making the housing floatable in the heated environment;

wherein the programmable temperature actuated control and temperature indicating means are encased within a compartment in the housing, the compartment sealed against the admission of water; and wherein the signaling and entertainment means comprises a tape cassette player and speaker enclosed within the housing.

13. The apparatus of claim 12 wherein the housing further comprises an opening for inserting and removing tape cassettes and the housing further comprises a cover hinged to the opening and a rubberized seal between the cover and the opening to prevent the admission of water therein.

14. A temperature actuated signaling and entertainment apparatus for a heated environment, wherein the apparatus comprises:

a housing;

a signaling and entertainment means encased within the housing and having an on/off switch controlling the playing of the signaling and entertainment means;

a programmable temperature actuated control having a temperature sensing means contacting the heated environment, a temperature indicating means on the housing, a connector between the programmable temperature actuated control and the on/off switch, and a means for programming the temperature actuated control to activate the on/off switch between the preset temperature limits for the heated environment, so that the programmable temperature actuated control actuates the on/off switch to turn the signaling and entertainment means on when the temperature in the heated environment is within the preset temperature limits and turn the signaling and entertainment means off when the temperature in the heated environment is outside the preset temperature limits;

wherein the housing has an exterior shell sealed against the admission of water and the heated environment is a heated water environment;

wherein the housing further comprises a lighter than water means making the housing floatable in the heated environment;

wherein the programmable temperature actuated control and temperature indicating means are encased within a compartment in the housing, the compartment sealed against the admission of water; and wherein the signaling and entertainment means comprises a compact disc player and speaker enclosed within the housing.

15. The apparatus of claim 14 wherein the housing further comprises an opening for inserting and removing compact discs and the housing further comprises a cover hinged to the opening and a rubberized seal between the cover and the opening to prevent the admission of water therein.

16. A temperature actuated signaling and entertainment apparatus for a heated environment, wherein the apparatus comprises:

a housing;

a signaling and entertainment means encased within the housing and having an on/off switch controlling the playing of the signaling and entertainment means;

a programmable temperature actuated control having a temperature sensing means contacting the heated environment, a temperature indicating means on the housing, a connector between the programmable temperature actuated control and the on/off switch, and a means for programming the temperature actuated control to activate the on/off switch between the preset temperature limits for the heated environment, so that the programmable temperature actuated control actuates the on/off switch to turn the signaling and entertainment means on when the temperature in the heated environment is within the preset temperature limits and turn the signaling and entertainment means off when the temperature in the heated environment is outside the preset temperature limits;

wherein the housing has an exterior shell sealed against the admission of water and the heated environment is a heated water environment;

wherein the housing further comprises a lighter than water means making the housing floatable in the heated environment;

wherein the programmable temperature actuated control and temperature indicating means are encased within a compartment in the housing, the compartment sealed against the admission of water; and wherein the signaling and entertainment means comprises a television and speaker enclosed within the housing and having exterior volume and tuning controls outside the housing.

* * * * *